US010008779B2

(12) United States Patent
Boryssenko et al.

(10) Patent No.: US 10,008,779 B2
(45) Date of Patent: Jun. 26, 2018

(54) DIELECTRIC-FREE METAL-ONLY DIPOLE-COUPLED RADIATING ARRAY APERTURE WITH WIDE FIELD OF VIEW

(71) Applicant: Nuvotronics, INC, Radford, VA (US)

(72) Inventors: Anatoliy O. Boryssenko, Belchertown, MA (US); Kenneth Vanhille, Cary, NC (US); Benjamin L. Cannon, Cary, NC (US)

(73) Assignee: Nuvotronics, INC, Radford, VA (US)

( * ) Notice: Subject to any disclaimer, the term of this patent is extended or adjusted under 35 U.S.C. 154(b) by 0 days. days.

(21) Appl. No.: 15/602,353

(22) Filed: May 23, 2017

(65) Prior Publication Data

US 2017/0256859 A1 Sep. 7, 2017

Related U.S. Application Data

(63) Continuation of application No. 14/567,655, filed on Dec. 11, 2014.

(60) Provisional application No. 61/914,693, filed on Dec. 11, 2013.

(51) Int. Cl.

| | |
|---|---|
| ***H01Q 21/00*** | (2006.01) |
| ***H01Q 9/28*** | (2006.01) |
| ***H01Q 1/48*** | (2006.01) |
| ***H01Q 9/26*** | (2006.01) |
| ***H01Q 21/26*** | (2006.01) |
| ***H01Q 5/40*** | (2015.01) |
| ***H01Q 5/25*** | (2015.01) |
| ***H01Q 25/00*** | (2006.01) |
| ***H01Q 23/00*** | (2006.01) |
| ***H01Q 21/06*** | (2006.01) |

(52) U.S. Cl.

CPC ..... *H01Q 9/28* (2013.01); *H01Q 1/48* (2013.01); *H01Q 5/25* (2015.01); *H01Q 5/40* (2015.01); *H01Q 9/26* (2013.01); *H01Q 21/062* (2013.01); *H01Q 21/26* (2013.01); *H01Q 23/00* (2013.01); *H01Q 25/00* (2013.01)

(58) Field of Classification Search

CPC ..... H01Q 5/48; H01Q 21/062; H01Q 21/26; H01Q 19/108; H01Q 5/40; H01Q 21/06; H01Q 7/00

USPC ..... 343/726, 727, 793–797, 853, 893

See application file for complete search history.

(56) References Cited

U.S. PATENT DOCUMENTS

| | | | |
|---|---|---|---|
| 3,820,041 | A | 6/1974 | Gewartowski |
| 4,218,685 | A | 8/1980 | Frosch |
| 5,557,291 | A | 9/1996 | Chu |
| 6,317,099 | B1 | 11/2001 | Zimmerman |
| 6,323,809 | B1 | 11/2001 | Maloney |
| 6,356,241 | B1 | 3/2002 | Jaeger |
| 6,512,487 | B1 | 1/2003 | Taylor |

(Continued)

FOREIGN PATENT DOCUMENTS

| | | |
|---|---|---|
| WO | 2014011675 | 1/2014 |

OTHER PUBLICATIONS

Hansen, Robert C. Phased array antennas. vol. 213. John Wiley & Sons, 2009.

(Continued)

*Primary Examiner* — Dameon E Levi
*Assistant Examiner* — Hasan Islam
(74) *Attorney, Agent, or Firm* — Niels Haun; Dann, Dorfman, Herrell and Skillman, P.C.

(57) ABSTRACT

Dielectric-free, metal-only, dipole-coupled radiating array aperture with wide field of view.

6 Claims, 10 Drawing Sheets

(56) References Cited

U.S. PATENT DOCUMENTS

| | | | | |
|---|---|---|---|---|
| 6,842,158 | B2 | 1/2005 | Jo | |
| 7,079,079 | B2 | 7/2006 | Jo | |
| 7,109,936 | B2 | 9/2006 | Mizoguchi | |
| 7,463,210 | B2 | 12/2008 | Rawnick | |
| 7,764,236 | B2 | 7/2010 | Hill | |
| 8,325,093 | B2 | 12/2012 | Holland | |
| 9,130,262 | B2 | 9/2015 | Park | |
| 2005/0040994 | A1 | 2/2005 | Mazoki | |
| 2005/0116862 | A1 | 6/2005 | du Toit | |
| 2008/0074339 | A1 | 3/2008 | Lee | |
| 2009/0284419 | A1 | 11/2009 | Kim | |
| 2010/0007572 | A1 | 1/2010 | Jones | |
| 2011/0025574 | A1 | 2/2011 | Tiezzi | |
| 2011/0057852 | A1* | 3/2011 | Holland | H01Q 9/28 343/795 |
| 2012/0146869 | A1 | 6/2012 | Holland | |
| 2013/0002501 | A1 | 1/2013 | Li | |
| 2015/0162665 | A1 | 6/2015 | Boryssenko | |
| 2017/0025767 | A1 | 1/2017 | Elsallal | |

OTHER PUBLICATIONS

Herd, J., and S. Duffy. "Overlapped digital subarray architecture for multiple beam phased array radar." Proceedings of the 5th European Conference on Antennas and Propagation (EUCAP). IEEE, 2011.

L. Ranzani, D. Kuester, K. J. Vanhille, A. Boryssenko, E. Grossman and Z. Popovic, "G-band Micro-fabricated Frequency-steered Arrays with 2deg/GHz Beam Steering," IEEE Transactions on Terahertz Science and Technology, vol. 3, No. 5, Sep. 2013.

Kindt, Rick W., and W. Raymond Pickles. All-Metal Flared-Notch Array Radiator for Ultrawideband Applications. No. NRL/MR/5310-10-9279. Naval Research Lab Washington DC Radar Analysis Branch, 2010.

Doane, Jonathan P., Kubilay Sertel, and John L. Volakis. "A wideband, wide scanning tightly coupled dipole array with integrated balun (TCDA-IB)." IEEE Transactions on Antennas and Propagation 61.9 (2013): 4538-4548.

Moulder, William F., Kubilay Sertel, and John L. Volakis. "Superstrate-enhanced ultrawideband tightly coupled array with resistive FSS." IEEE Transactions on Antennas and Propagation 60.9 (2012): 4166-4172.

Papantonis, Dimitrios K., and John L. Volakis. "Dual-polarization TCDA-IB with substrate loading." 2014 IEEE Antennas and Propagation Society International Symposium (APSURSI). IEEE, 2014.

Herd, J., et al. "Multifunction Phased Array Radar (MPAR) for aircraft and weather surveillance." 2010 IEEE Radar Conference. IEEE, 2010.

J. D. Dyson, "The equiangular spiral antenna," Wright Air Development Center, 1957.

Justin A. Kasemodel, et al.; A Miniaturization Technique for Wideband Tightly Coupled Phased Arrays; IEEE; 2009; pp. 1-4.

Elias A. Alwan,, Et al.; A Simple Equivalent CircuitModel for Ultrawideband Coupled Arrays; IEEE Antennas and Wireless Propagation Letters, vol. 11, 2012; pp. 117-120.

Nathanael J. Smith; Development of a 180° Hybrid Balun to Feed a Tightly Coupled Dipole X-Band Array; The Ohio State University 2010; pp. 1-52.

Justin A. Kasemodel; Realization of a Planar Low-Profile Broadband Phased Array Antenna; Dissertation, The Ohio State University 2010; pp. 1-120.

Justin A. Kasemodel, et al.; Low-Cost, Planar and Wideband Phased Array with Integrated Balun and Matching Network for Wide-Angle Scanning; IEEE 2010; pp. 2-4.

Erdinc Irci; Low-Profile Wideband Antennas Based on Tightly Coupled Dipole and Patch Elements; Dissertation, The Ohio State University 2011; pp. 1-126.

William F. Moulder; Novel Implementations of Ultrawideband Tightly Coupled Antenna Arrays; Dissertation, The Ohio State University 2012; pp. 1-133.

Ioannis Tzanidis; Ultrawideband Low-Profile Arrays of Tightly Coupled Antenna Elements: Excitation, Termination and Feeding Methods; Dissertation, The Ohio State University 2011; pp. 1-189.

Jonathan Doane; Wideband Low-Prole Antenna Arrays: Fundamental Limits and Practical Implementations; Dissertation, The Ohio State University 2013; pp. 1-265.

Justin A. Kasemodel et al.; Wideband Planar Array With Integrated Feed and Matching Network for Wide-Angle Scanning; IEEE Transactions on Antennas and Propagation, vol. 61, No. 9, Sep. 2013; pp. 4528-4537.

Jonathan P. Doane, et al.; Wideband, Wide Scanning Conformal Arrays with Practical Integrated Feeds; Proceedings of the "2013 International Symposium on Electromagnetic Theory"; pp. 859-862.

Steven S. Holland, et al.; Design and Fabrication of Low-Cost PUMA Arrays; IEEE; 2011; pp. 1976-1979.

Steven S. Holland; Low-Profile, Modular, Ultra-Wideband Phased Arrays; Dissertation, University of Massachusetts; Sep. 2011; pp. 1-327.

John T. Logan, et al.; A Review of Planar Ultrawideband Modular Antenna (PUMA) Arrays; Proceedings of the "2013 International Symposium on Electromagnetic Theory"; 2013; pp. 868-871.

D. Cavallo, et al.; Common-Mode Resonances in Ultra Wide Band Connected Arrays of Dipoles: Measurements from the Demonstrator and Exit Strategy; IEEE; 2009; pp. 435-438.

J. J. Lee, et al.; Performance of a Wideband (3-14 GHz) Dual-pol Array; IEEE; 2004; pp. 551-554.

Jian Bai, et al.; Ultra-wideband Slot-loaded Antipodal Vivaldi Antenna Array; IEEE; 2011; pp. 79-81.

E. Garca I, et al.; Elimination of Scan Impedance Anomalies in Ultra-Wide Band Phased Arrays of Differentially Fed Tapered Slot Antenna Elements; IEEE; 2008; pp. 1-4.

Eloy de Lera Acedo, et al.; Study and Design of a Differentially-Fed Tapered Slot Antenna Array; IEEE Transactions on Antennas and Propagation, vol. 58, No. 1, Jan. 2010; pp. 68-78.

Y. Chen, et al.; A Novel Wideband Antenna Array With Tightly Coupled Octagonal Ring Elements; Progress in Electromagnetics Research, vol. 124, 55-70; 2012.

J. Y. Li; Design of Broadband Compact Size Antenna Comprised of Printed Planar Dipole Pairs; Progress in Electromagnetics Research Letters, vol. 12, 99-109; 2009.

Mats Gustafsson; Broadband array antennas using a self-complementary antenna array and dielectric slabs; CODEN: LUTEDX/(TEAT-7129)/1-8; Dec. 13, 2004.

Terry Richard Vogler; Analysis of the Radiation Mechanisms in and Design of Tightly-Coupled Antenna Arrays; Dissertation, Virginia Polytechnic Institute and State University; Sep. 10, 2010; pp. 1-251.

S. G. Hay, et al.; Analysis of common-mode effects in a dual-polarized planar connected-array antenna; Radio Science, vol. 43, RS6S04, doi:10.1029/2007RS003798; 2008.

A. Chippendale,, et al.; Chequerboard Phased Array Feed Testing for ASKAP; May 3, 2010; pp. 1-41.

Yan Fei, et al.; A Simple Wideband Dual-Polarized Array With Connected Elements; University of Electronic Science and Technology of China (UESTC); 2013; pp. 1-21.

Fei Yan, et al. ; A Simple Wideband Dual-Polarized Array With Connected Elements; Institute of Applied Physics and Computational Mathematics; 978-1-4673-5317-5/13 2013 IEEE.

Tomasz Michna, et al.; Characterization of an Impulse-Transmitting UWB Antenna Array with Dispersive Feed Network; Characterization of an Impulse-Transmitting UWB; 2008; pp. 59-62. Antenna Array with Dispersive Feed Network.

Martin Wagner, et al.; Multi-B and Polarizat ion-Ver satile Array Antenna for Smart Antenna Applications in Cellular Systems; 2004 EEE MTT-S Digest; pp. 1769-1772.

Jeremie Bourqui, et al.; Balanced Antipodal Vivaldi Antenna With Dielectric Director for Near-Field Microwave Imaging; EEE Transactions on Antennas and Propagation, vol. 58, No. 7; Jul. 2010.

R.N. Simons, et al.; Impedance matching of tapered slot antenna using a dielectric transformer; Electronics Letters Nov. 26, 1998 vol. 34 No. 24.

(56) References Cited

OTHER PUBLICATIONS

S. A. Adamu, et al.; Review on Gain and Directivity Enhancement Techniques of Vivaldi Antennas; International Journal of Scientific & Engineering Research, vol. 8, Issue 3, Mar. 2017; ISSN 2229-5518.
S. Livingston, et al.; Evolution of Wide Band Array Designs; 2011; IEEE pp. 1957-1960.
J. J. Lee,W et al.; Wide Band Long Slot Array Antennas; IEEE; 2003; pp. 452-455.
Johnson J. H. Wang; A New Planar Multioctave Broadband Traveling-Wave Beam-Scan Array Antenna; Wang Electro-Opto Corporation; 2007; pp. 1-4.
John Toon; New planar design allows fabrication of ultra-wideband, phased-array antennas; 100-TO-1 Bandwidth @ Winter 2006; pp. 18-19.
Hans Steyskal, et al.; Design of Realistic Phased Array Patch Elements Using a Genetic Algorithm; Air Force Research Laboratory; 2010; pp. 246-252.
Benjamin Riviere, et al.; Ultrawideband Multilayer Printed Antenna Arrays With Wide Scanning Capability; 2015; IEEE; 514-515.
Boryssenko, et al.; A Matlab Based Universal CEM CAD Optimizer; 2012; IEEE International Symposium on Antennas and Propagation; pp. 1-25.
Justin A. Kasemodel, et al.; A Novel Non-Symmetric Tightly Coupled Element for Wideband Phased Array Apertures; Dissertation The Ohio State University; 2010; pp. 1-13.
Markus H. Novak, et al.; Ultra-Wideband Phased Array Antennas for Satellite Communications up to Ku- and Ka-Band; May 2015; pp. 1-6.
Wajih Elsallal, et al.; Charateristics of Decade-bandwidth, Balanced Antipodal Vivaldi Antenna (BAVA) Phased Arrays with Time-Delay Beamformer Systems; IEEE International Symposium on Phased Array Systems and Technology.
Michel Arts, et al.; Broadband Differentially Fed Tapered Slot Antenna Array for Radio Astronomy Applications; 2009; 3rd European Conference on Antennas and Propagation; pp. 1-5.
Yongwei Zhang, et al.; Octagonal Ring Antenna for a Compact Dual-Polarized Aperture Array; IEEE Transactions on Antennas and Propagation, vol. 59, No. 10, Oct. 2011; pp. 3927-3932.
Hisao Iwasaki, et al.; A Circularly Polarized Microstrip ANfENNA Using Singly-Fed Proximity Ccupled Feed; Proceedings of ISAP '92, Sapporo, Japan; pp. 797-800.
Ghannoum, H. et al. "Probe Fed Stacked Patch Antenna for UWB Sectoral Applications," IEEE International Conference on Ultra-Wideband 2005. pp. 97-102.
A. Boryssenko, J. Arroyo, R. Reid, M.S. Heimbeck, "Substrate free G-band Vivaldi antenna array design, fabrication and testing" 2014 IEEE International Conference on Infrared, Millimeter, and Terahertz Waves, Tucson, Sep. 2014.
B. Cannon, K. Vanhille, "Microfabricated Dual-Polarized, W-band Antenna Architecture for Scalable Line Array Feed," 2015 IEEE Antenna and Propagation Symposium, Vancouver, Canada, Jul. 2015.
D. Filipovic, G. Potvin, D. Fontaine, C. Nichols, Z. Popovic, S. Rondineau, M. Lukic, K. Vanhille, Y. Saito, D. Sherrer, W. Wilkins, E. Daniels, E. Adler, and J. Evans, "Integrated micro-coaxial Ka-band antenna and array," GomacTech 2007 Conference, Mar. 2007.
E. Cullens, L. Ranzani, E. Grossman, Z. Popovic, "G-Band Frequency Steering Antenna Array Design and Measurements," Proceedings of the XXXth URSI General Assembly, Istanbul, Turkey, Aug. 2011.
Gao, S. et al. "A Broad-Band Dual-Polarized Microstrip Patch AntennaWith Aperture Coupling," IEEE Transactions on Antennas and Propagation, vol. 51, No. 4, Apr. 2003. pp. 898-900.
Gao, S.C., et al., Dual-polarised Wideband Microstrip Antenna, Electronic Letters, Aug. 30, 2001, vol. 37, No. 18, pp. 1106-1107.
Guo, Y.X. et al. "L-probe proximity-fed short-circuited patch antennas," Electronics Letters, vol. 35 No. 24, Nov. 25, 1999. pp. 2069-2070.
H. Zhou, N. A. Sutton, D. S. Filipovic, "Surface micromachined millimeter-wave log-periodic dipole array antennas," IEEE Trans. Antennas Propag., Oct. 2012, vol. 60, No. 10, pp. 4573-4581.
H. Zhou, N. A. Sutton, D. S. Filipovic, "Wideband W-band patch antenna," 5th European Conference on Antennas and Propagation , Rome, Italy, Apr. 2011, pp. 1518-1521.
Holzheimer, et al., Performance Enhancements with Applications of the Coaxial Cavity Antenna, pp. 171-193.
Hsu, Wen-Hsiu et al. "Broadband Aperture-Coupled Shorted-Patch Antenna," Microwave and Optical Technology Letters, vol. 28, No. 5, Mar. 5, 2001. pp. 306-307.
J. M. Oliver, J.-M. Rollin, K. Vanhille, S. Raman, "A W-band micromachined 3-D cavity-backed patch antenna array with integrated diode detector," IEEE Trans. Microwave Theory Tech., Feb. 2012, vol. 60, No. 2, pp. 284-292.
J. M. Oliver, P. E. Ralston, E. Cullens, L. M. Ranzani, S. Raman, K. Vanhille, "A W-band Micro-coaxial Passive Monopulse Comparator Network with Integrated Cavity-Backed Patch Antenna Array," 2011 IEEE MTT-S Int. Microwave, Symp., Baltimore, MD, Jun. 2011.
J. Mruk, Z. Hongyu, M. Uhm, Y. Saito, D. Filipovic, "Wideband mm-Wave Log-Periodic Antennas," 3rd European Conference on Antennas and Propagation, pp. 2284-2287, Mar. 2009.
J. R. Mruk, N. Sutton, D. S. Filipovic, "Micro-coaxial fed 18 to 110 GHz planar log-periodic antennas with RF transitions," IEEE Trans. Antennas Propag., vol. 62, No. 2, Feb. 2014, pp. 968-972.
J.R. Mruk, Y. Saito, K. Kim, M. Radway, D. Filipovic, "A directly fed Ku- to W-band 2-arm Archimedean spiral antenna," Proc. 41st European Microwave Conf., Oct. 2011, pp. 539-542.
K. M. Lambert, F. A. Miranda, R. R. Romanofsky, T. E. Durham, K. J. Vanhille, "Antenna characterization for the Wideband Instrument for Snow Measurements (WISM)," 2015 IEEE Antenna and Propagation Symposium, Vancouver, Canada, Jul. 2015.
K. Vanhille, M. Lukic, S. Rondineau, D. Filipovic, and Z. Popovic, "Integrated micro-coaxial passive components for millimeter-wave antenna front ends," 2007 Antennas, Radar, and Wave Propagation Conference, May 2007.
L. Ranzani, N. Ehsan, Z. Popovic, "G-band frequency-scanned antenna arrays," 2010 IEEE APS-URSI International Symposium, Toronto, Canada, Jul. 2010.
M. Lukic, D. Fontaine, C. Nichols, D. Filipovic, "Surface micromachined Ka-band phased array antenna," Presented at Antenna Applic. Symposium, Monticello, IL, Sep. 2006.
M. Lukic, K. Kim, Y. Lee, Y. Saito, and D. S. Filipovic, "Multiphysics design and performance of a surface micromachined Ka-band cavity backed patch antenna," 2007 SBMO/IEEE Int. Microwave and Optoelectronics Conf., Oct. 2007, pp. 321-324.
M. V. Lukic, and D. S. Filipovic, "Integrated cavity-backed ka-band phased array antenna," Proc. IEEE-APS/URSI Symposium, Jun. 2007, pp. 133-135.
M. V. Lukic, and D. S. Filipovic, "Surface-micromachined dual Ka-and cavity backed patch antenna," IEEE Trans. Antennas Propag., vol. 55, No. 7, pp. 2107-2110, Jul. 2007.
Mruk, J.R., Saito, Y., Kim, K., Radway, M., Filipovic, D.S., "Directly fed millimetre-wave two-arm spiral antenna," Electronics Letters, Nov. 25, 2010, vol. 46 , issue 24, pp. 1585-1587.
N. Chamberlain, M. Sanchez Barbetty, G. Sadowy, E. Long, K. Vanhille, "A dual-polarized metal patch antenna element for phased array applications," 2014 IEEE Antenna and Propagation Symposium, Memphis, Jul. 2014. pp. 1640-1641.
N. Jastram, D. S. Filipovic, "Parameter study and design of W-band micromachined tapered slot antenna," Proc. IEEE-APS/URSI Symposium, Orlando, FL, Jul. 2013, pp. 434-435.
N. Sutton, D.S. Filipovic, "Design of a K- thru Ka-band modified Butler matrix feed for a 4-arm spiral antenna," 2010 Loughborough Antennas and Propagation Conference, Loughborough, UK, Nov. 2010, pp. 521-524.
N.A. Sutton, D. S. Filipovic, "V-band monolithically integrated four-arm spiral antenna and beamforming network," Proc. IEEE-APS/URSI Symposium, Chicago, IL, Jul. 2012, pp. 1-2.

(56) References Cited

OTHER PUBLICATIONS

Nakano, M., et al., "Feed Circuits of Double-Layered Self-Diplexing Antenna for Mobile Satelite Communications", Transactions on Antennas and Propagation, vol. 40, No. 1, Oct. 1992, pp. 1269-1271.
Oliver, J.M. et al., "A 3-D micromachined W-band cavity backed patch antenna array with integrated rectacoax transition to wave guide," 2009 Proc. IEEE International Microwave Symposium, Boston, MA 2009.
Sevskiy, S. and Wiesbeck, W., "Air-Filled Stacked-Patch Antenna," ITG-Fachberichte. No. 178, (2003). pp. 53-56.
T. E. Durham, C. Trent, K. Vanhille, K. M. Lambert, F. A. Miranda, "Design of an 8-40 GHz Antenna for the Wideband Instrument for Snow Measurements (WISM)," 2015 IEEE Antenna and Propagation Symposium, Vancouver, Canada, Jul. 2015.
Tim Holzheimer, Ph.D., P .E., The Low Dispersion Coaxial Cavity as an Ultra Wideband Antenna, 2002 IEEE Conference on Ultra Wideband Systems and Technologies, pp. 333-336.
Vallecchi, A. et al. "Dual-Polarized Linear Series-Fed Microstrip ArraysWith Very Low Losses and Cross Polarization," IEEE Antennas and Wireless Propagation Letter, vol. 3, 2004. pp. 123-126.
Y. Saito, J.R. Mruk, J.-M. Rollin, D.S. Filipovic, "X- through Q-band log-periodic antenna with monolithically integrated u-coaxial impedance transformer/feeder," Electronic Letts. Jul. 2009, pp. 775-776.
Y. Saito, M.V. Lukic, D. Fontaine, J.-M. Rollin, D.S. Filipovic, "Monolithically Integrated Corporate-Fed Cavity-Backed Antennas," IEEE Trans. Antennas Propag., vol. 57, No. 9, Sep. 2009, pp. 2583-2590.
Z. Popovic, "Micro-coaxial micro-fabricated feeds for phased array antennas," in IEEE Int. Symp. on Phased Array Systems and Technology, Waltham, MA, Oct. 2010, pp. 1-10. (Invited).
Zurcher, J. "Broadband Patch Antennas," Chapter 3, 1995. pp. 45-61.
Ben Munk et al.; "A Low-Profile Broadband Phased Array Antenna"; The Ohio State University ElectroScience Laboratory, Dept. of Electrical Engineering; 2003 pp. 448-451.
Woorim Shin, et al. "A 108-114 GHz 4 4 Wafer-Scale Phased Array Transmitter With High-Efficiency On-Chip Antennas"; IEEE Journal of Solid-State Circuits, vol. 48, No. 9, Sep. 2013.
Harold A. Wheeler; "Simple Relations Derived from a Phased-Array Antenna Made of an Infinite Current Sheet"; IEEE Transactions on Antennas Propagation; Jul. 1965; pp. 506-514.
E. G. Magill, et al.; Wide-Angle Impedance Matching of a Planar Array Antenna by a Dielectric Sheet; IEEE Transactions on Antennas Propagation; Jan. 1966; vol. AP-14 No. 1; pp. 49-53.
P. W. Hannan, et al.; Impedance Matching a Phased-Array Antenna Over Wide Scan Angles by Connecting Circuits; Impedance Matching a Phased-Array Antenna; Jan. 1965 pp. 28-34.
James E. Dudgeon, et al;Microstrip Technology and Its Application to Phased Array Compensation; Jan. 21, 1972; pp. 1-81.
Kerry Speed, et al; Progress on the 8-40 GHz Wideband Instrument for Snow Measurements(WISM); Harris.com Earth Science Tech nology Forum 2014 Oct. 28-30, 2014 Leesburg, VA; pp. 1-36.
Mark Jones, et al.; A New Approach to Broadband Array Design Using Tightly Coupled Elements; IEEE; 2007; pp. 1-7.
W. M. Qureshi,, et al., Fabrication of a Multi-Octave Phased Array Aperture; 6th EMRS DTC Technical Conference—Edinburgh; 2009; pp. 1-5.
John Forrest McCann, B.S.; On the Design of Large Bandwidth Arrays of Slot Elements With Wide Scan Angle Capabilities; Thesis The Ohio State University; 2006; pp. 1-102.
Tengfei Xia et al.; Design of a Tapered Balun for Broadband Arrays With Closely Spaced Elements; IEEE Antennas and Wireless Propagation Letters, vol. 8, 2009; pp. 1291-1294.
Frank B. Gross; Ultra-wideband antenna arrays—The basics—Part I; Apr. 7, 2011.

* cited by examiner

DIELECTRIC-FREE METAL-ONLY DIPOLE-COUPLED RADIATING ARRAY APERTURE WITH WIDE FIELD OF VIEW

RELATED APPLICATIONS

This is application in a continuation application of U.S. application Ser. No. 14/567,655, filed Dec. 11, 2014 now U.S. Pat. No. 9,666,947, which in turn claims the benefit of priority of U.S. Provisional Application No. 61/914,693, filed on Dec. 11, 2013, the entire contents of which applications are incorporated herein by reference.

FIELD OF THE INVENTION

The present invention relates generally to radiating array apertures, and more particularly, but not exclusively, to coupled-dipole arrays which may be metal-only and dielectric-free.

BACKGROUND OF THE INVENTION

There are still unmet demands from defense and commercial markets for very low profile array antennas capable of supporting transmit and receive operations with arbitrary polarization states and the ability to scan down to angles approaching the grazing regime with acceptable active reflection coefficients. Besides just the aforementioned major electrical requirements, such prospective arrays have to be of high radiation efficiency and low insertion loss along with their advanced structural properties. Such structural properties may include low complexity to fabricate, assemble and install while minimizing or excluding manual labor, as well as mechanical ability to withstand, for example, multi-G impacts. Also using predominantly low-cost fabrication materials and technologies suitable for mass production is preferable to achieve break-through technical and economic features.

SUMMARY OF THE INVENTION

In one of its aspects, the invention relates to the design and implementation of Ultra—(i.e., up to several octaves or up to and/or surpassing decade bandwidth), dielectric-free, metal-only, very-low-profile array of radiating apertures capable of supporting transmit and receive operation with arbitrary polarization states. The array of radiating apertures may be structurally-simple and suitable for additive manufacturing. The array of radiating apertures in accordance with the present invention may provide an antenna that is capable of scanning to angles approaching the grazing regime with acceptable active reflection coefficients. An array cell may be made from one dipole if just one polarization is required and/or from two such orthogonal dipoles to produce arbitrary polarization states. The dipoles may be self-supporting metal structures with integrated edge-coupling and feed networks to connect the dipoles to RF transmitter/receiver circuits below the ground plane. In addition, the array of electrically connected dipoles may be placed above and in parallel to the ground plane to permit unidirectional radiation in the upper semi-sphere.

Devices of the present invention may exclude the use of dielectric construction elements, because it can be difficult to find good low-loss dielectric for high frequencies. Dielectrics may introduce additional losses especially at higher frequencies, and can contribute to additional weight, size and cost. In addition, a top thick dielectric covering might cause array blindness by launching a surface wave instead of radiating the electromagnetic energy in designated scan directions. A metal-only radiator structure of the present invention may be made of two symmetrical loop-like, three-branch, metal parts. The first, generally vertical branch may start from a feed point near the ground plane enabling connection to the front-end circuits below the ground and may extend to certain height. Functionally, the first branch may serve for transmission of RF signals between the circuits below the ground plane and a second radiating branch. This second, generally horizontal section branch may form a radiating arm of the dipole. The second branch's functional role in the array may be to transmit or receive electromagnetic energy. At other end, the second, generally horizontal branch may extend close to the boundary of the array cell where a third, generally vertical branch starts. This third branch may then be shorted to ground. The function of this third, generally vertical branch may be twofold: (i) electrically, it may enable coupling between adjacent array cells through electro-magnetic coupling between the vertical sections of adjacent cells; (ii) mechanically, it may support the whole structure. Indeed, the structures of the present invention may be self-supporting and not require any additional support. In addition, the structures may be described by several parameters including cross-sectional dimensions, viz. to vertical ones and horizontal ones. Further, the second branch may start closer to the ground plane on the feed side than it ends on the side near the support. This may be done for impedance matching over a greater bandwidth than what would be typical for flat precisely horizontal branches. Moreover, the vertical branches do not have to couple using flat vertical surfaces. Coupling could be implemented using interwoven or interleaved edges, which would provide additional degrees of design freedom.

For some set of geometrical dimensions, a 100 Ohm differential impedance can be supported that enables next transformation to a pair of 50 Ohm single-ended impedance feeds below the ground plane. No additional impedance transformation is required. In the array structure of the present invention, common mode resonance may be shifted to the higher frequency end. Thus, the common mode resonance does not affect the major array passband. In the present structures, a bandwidth greater than an octave is supported. For example, for a 0.75 mm mm tall radiator (height of the third branch) the array can operate across 40-120 GHz and so on. In this configuration, the size of the unit cell is 1.4 mm on an edge. The cross section of the dipole structure could be between 50 microns and 250 microns or more. Moreover, the array may be configured to support arbitrary polarization states by combining two orthogonal linear polarizations. A dual-linear polarized array layout may be made in off-set or phase-center coincident mode.

BRIEF DESCRIPTION OF THE DRAWINGS

The foregoing summary and the following detailed description of exemplary embodiments of the present invention may be further understood when read in conjunction with the appended drawings, in which:

FIGS. 1*a*-1*c* schematically illustrate an exemplary configuration of a unit cell of a single-polarized antenna in accordance with the present invention, in which FIG. 1*a* illustrates a top-down view of the unit cell, FIG. 1*b* illustrates a isometric view, and FIG. 1*c* illustrates a cross-sectional view of FIG. 1*b* taken down a midline of differentially-fed shorted arms of the antenna;

FIGS. 3*a*-3*c* schematically illustrate another exemplary configuration of a unit cell of a single-polarized antenna similar to that of FIGS. 1*a*-1*c* but having a uniform cross-section in the antenna portions, in which FIG. 3*a* illustrates a top-down view of the unit cell, FIG. 3*b* illustrates a isometric view, and FIG. 3*c* illustrates a cross-sectional view of FIG. 3*b;*

FIGS. 7*a*-7*c* schematically illustrate a two-dimensional, 4-element by 4-element array of dual-polarized, differentially-fed, shorted dipoles in accordance with the present invention, in which FIG. 7*a* illustrates a top-down view of a unit cell of the array, FIG. 7*b* illustrates a isometric view of the unit cell, and FIG. 7*c* illustrates an isometric view of the array;

FIGS. 8*a*-8*c* schematically illustrate a further two-dimensional, 4-element by 4-element array of dual-polarized, differentially-fed, shorted dipoles in accordance with the present invention, in which FIG. 8*a* illustrates a top-down view of a unit cell of the array, FIG. 8*b* illustrates a isometric view of the unit cell, and FIG. 8*c* illustrates an isometric view of the array;

DETAILED DESCRIPTION OF THE INVENTION

Figure 1A:
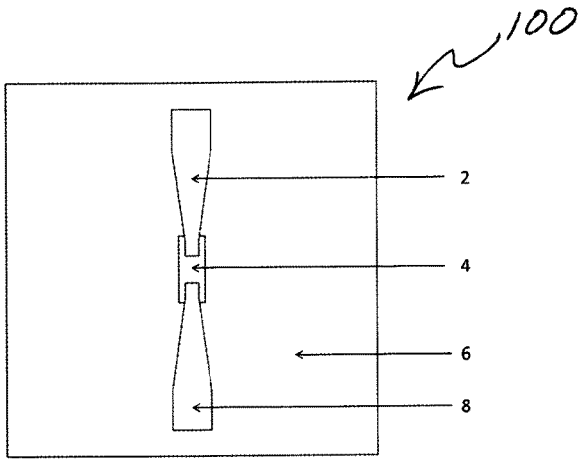
Figure 1B:
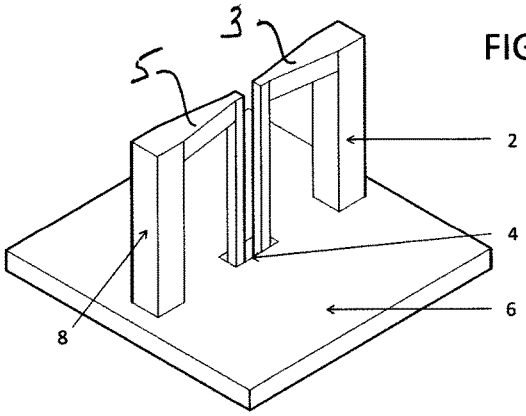
Figure 1C:
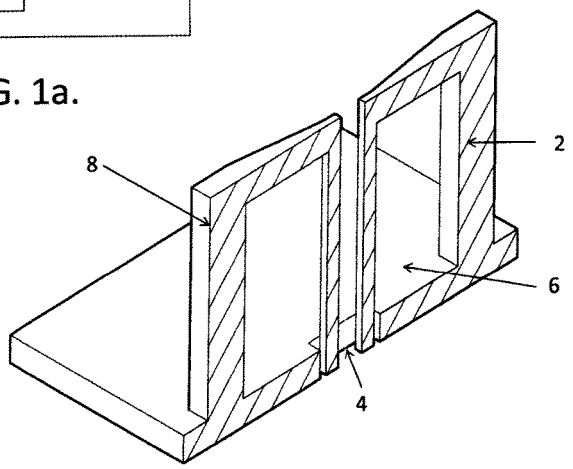
Figure 1D:
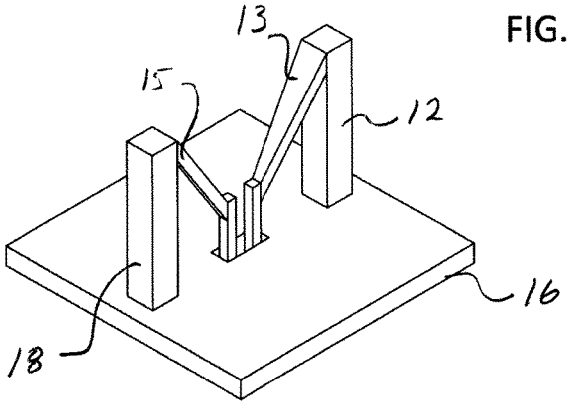
FIG. 1*d* schematically illustrates an alternative configuration of a unit cell of a single-polarized antenna in accordance with the present invention.
Figure 3A:
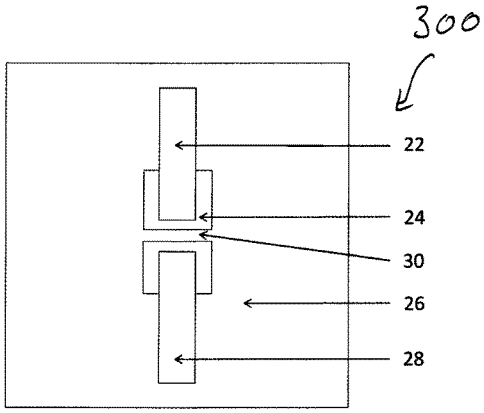
Figure 3B:
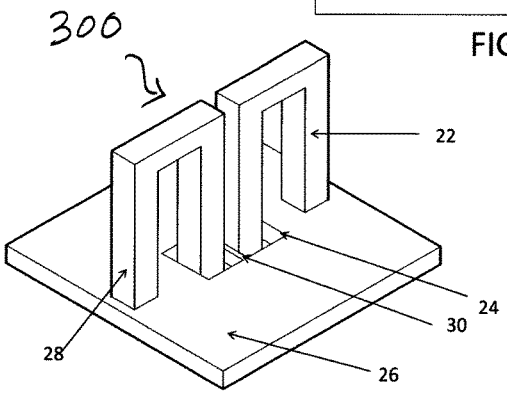

Referring now to the figures, wherein like elements are numbered alike throughout, FIGS. 1*a*-1*c* schematically illustrate an exemplary configuration of a unit cell 100 of a single-polarized antenna in accordance with the present invention. The antenna may include a differentially fed shorted arms 2, 8 of the antenna positioned above a ground surface (such as ground plane 6 or other surface shape, e.g., a conformal surface) and fed via a feed region 4, which may include one or more openings. (Though exemplary configurations of present invention may be illustrated as having a ground "plane", other surface shapes, such as conformal surfaces, may be provided for grounding.) The arms 2, 8 may cooperate to provide a dipole. The feed region 4 may be provided with no wall separating the feed points for the two differentially-fed shorted arms 2, 8. Alternatively, a wall 30 may be provided as illustrated in FIGS. 3*a*-3*b*. The arms 2, 8 may have a cross-sectional dimension that varies along the arms 2, 8 and may or may not be identical to one another. Alternatively, the arms 22, 28 may be 'U'-shaped of constant cross-sectional dimension depending on the requirements of the design or to optimize performance, FIGS. 3*a*-3*c*. Still further, opposing ends of the arms 2, 8 may be of the same height above the ground plane 6 with a horizontal leg 3, 5 therebetween, FIG. 1*b*. Instead, the opposing ends of the arms 12, 18 may be of different height above the ground plane 16 with a sloped leg 13, 15 therebetween, FIG. 1*d*. This may be done for impedance matching over a greater bandwidth than what would be typical for flat precisely horizontal legs.

Figure 2:
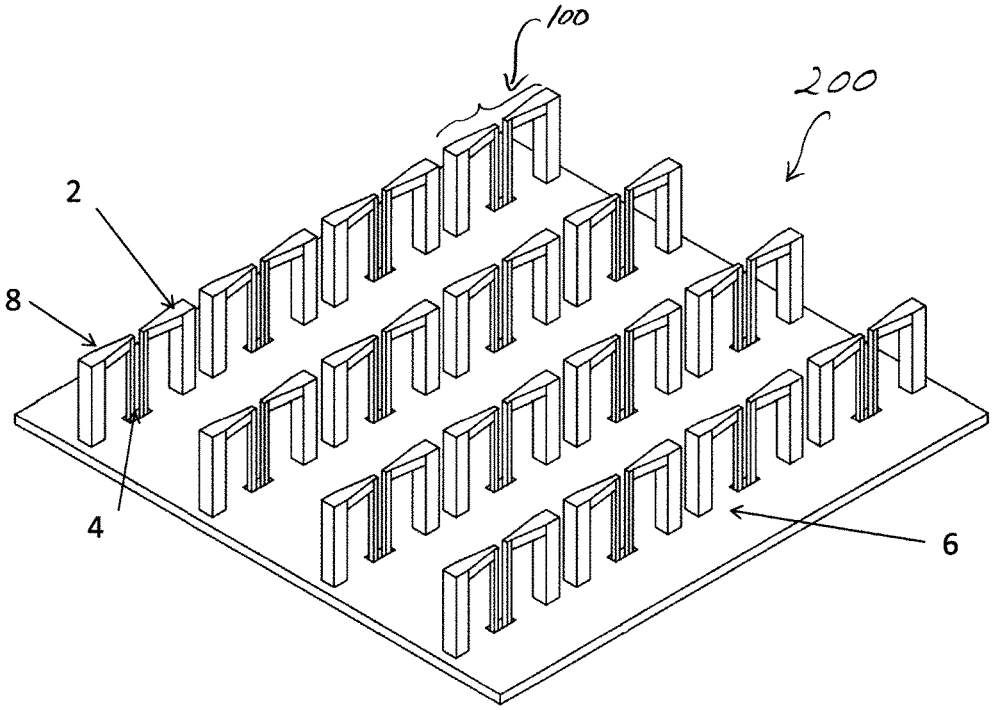
FIG. 2 schematically illustrates a four-element by four-element two-dimensional array of the single-polarized unit cell depicted in FIGS. 1*a*-1*c;*
Figure 3C:
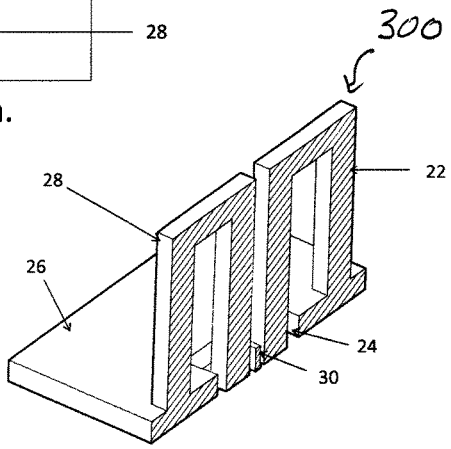
Figure 10A:
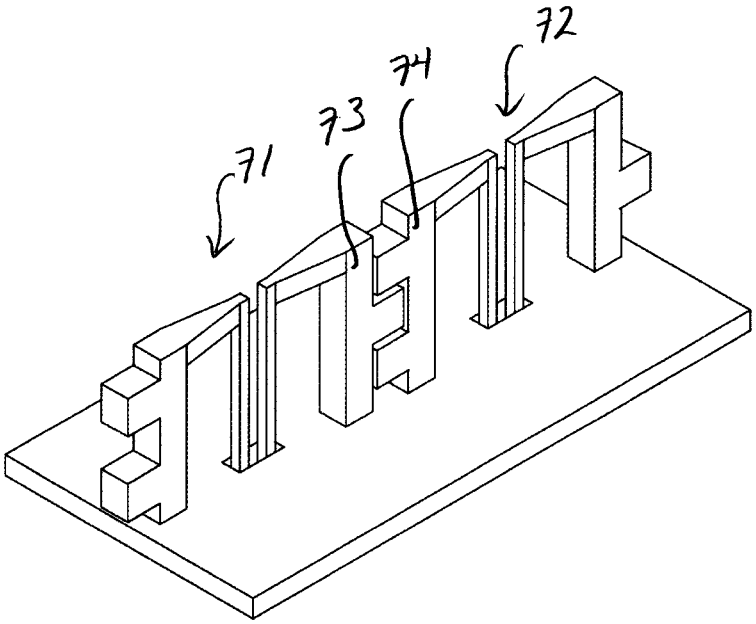
FIGS. 10*a*, 10*b* schematically illustrate coupling between the adjacent dipoles using interleaved or interwoven arms, respectively.

Similar to FIGS. 1*a*-1*c*, the structure of FIGS. 3*a*-3*c* may include a ground plane 26 and feed region 24. In addition, an array 200 of the antennas 100 of FIGS. 1*a*-1*c* (or antennas 300 of FIGS. 3*a*-3*c*) may be provided as illustrated in FIG. 2. In such as case the field generated by a dipole (i.e., pair of arms 2, 8) of the array 200 may be couple adjacent dipoles. For stronger coupling between the adjacent dipoles 71, 72, the legs 73, 74 could be interdigitated in either the vertical or horizontal direction (or both), FIG. 10*a*, which could be formed, for example, by the PolyStrata® process. Alternatively, the coupling between the adjacent dipoles 81, 82 may be implemented with interwoven legs 83, 84 that could be formed by 3D metal printing. Such coupling using interwoven or interleaved legs could provide additional degrees of design freedom.

Figure 4:
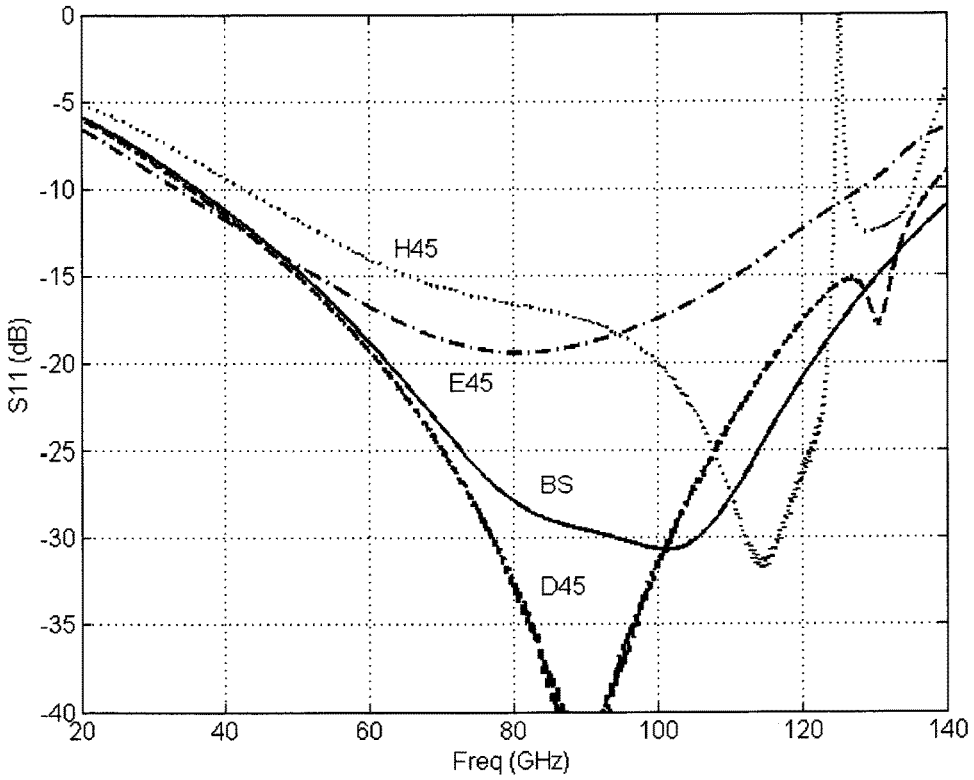
FIGS. 4-6 illustrate the expected performance of an antenna of the present invention.
Figure 5:
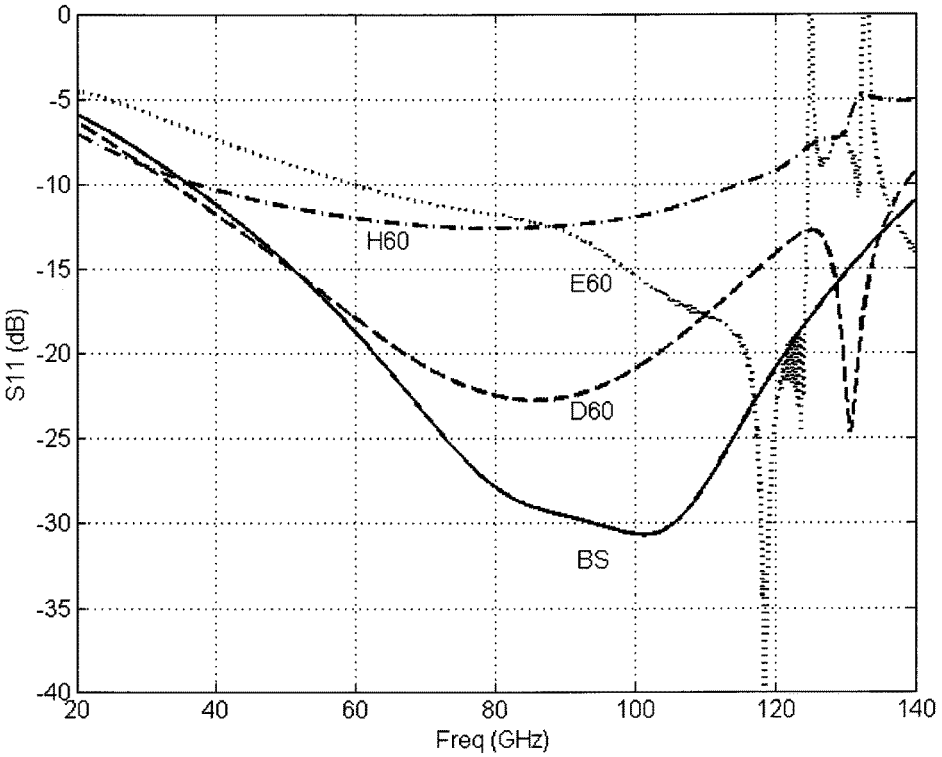
Figure 6:
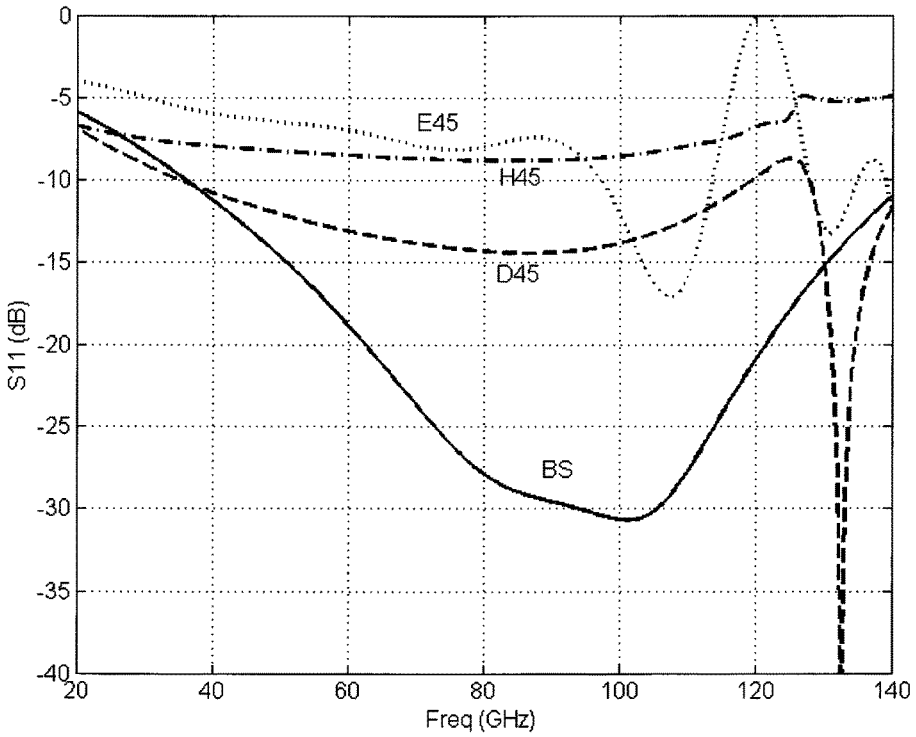

The expected performance of antenna designs of the present invention is illustrated in FIGS. 4-6 for a point design that should operate from roughly 40 GHz to 120 GHz. FIG. 4 illustrates the active reflection coefficient, comparing no scanning (BS) for an element in the array to when the element is driven to 45 degrees in the e plane (E45), or 45 degrees in the h plane of the antenna (H45), or 45 degrees in both planes (D45). FIG. 5 shows the active reflection coefficient, comparing no scanning (BS) for an element in the array to when the element is driven to 60 degrees in the e plane (E60), or 60 degrees in the h plane of the antenna (H60) or 60 degrees in both planes (D60). FIG. 6 shows the active reflection coefficient, comparing no scanning (BS) for an element in the array to when the element is driven to 75 degrees in the e plane (E75), or 75 degrees in the h plane of the antenna (H75) or 75 degrees in both planes (D75).

Figure 7A:
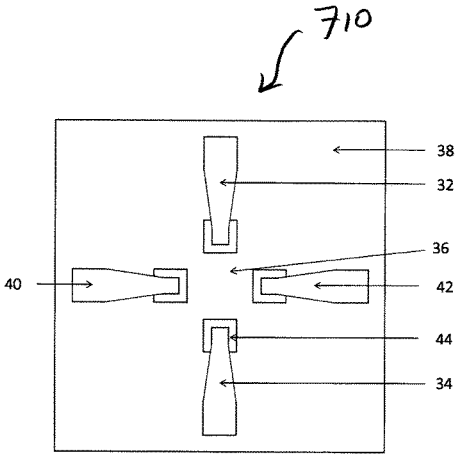
Figure 7B:
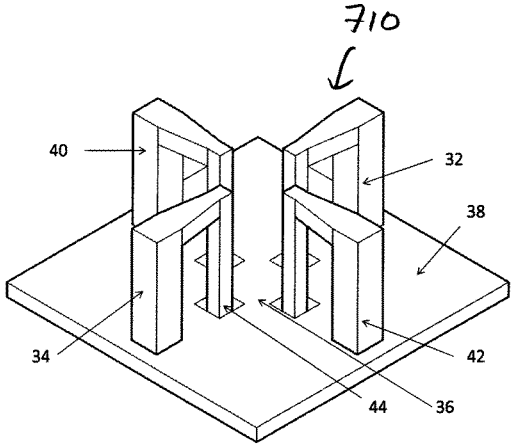
Figure 7C:
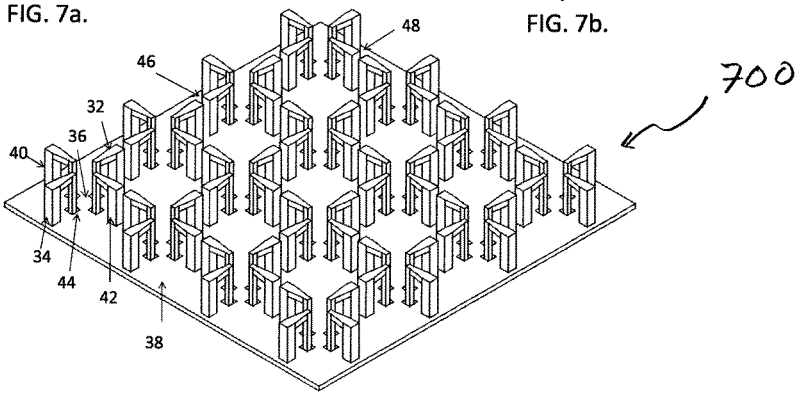

FIG. 7*c* shows a two-dimensional, 4-element by 4-element array 700 of dual-polarized differentially-fed shorted dipoles. The top view of the unit cell 710 that makes up the array 700 is shown in FIG. 7*a*. An isometric view of the unit cell 710 of the array 700 is shown in FIG. 7*b*. An isometric view of a representative 4×4 array 700 is shown in FIG. 7*c*. Arms 32 and 34 make up two halves of a first differentially-fed dipole element that is fed in polarization 1. Polarization 2 is orthogonal to polarization 1 and is fed by arms 40 and 42, which make up the two halves of a second differentially-fed dipole element. The shorted dipole elements that are oriented in the same direction as 32 and 34 throughout the array 700 also feed polarization 1. This polarization means that the electric field vectors for electromagnetic waves are oriented in the same direction as the long dimension of the physical components of arms 32 and 34 that are oriented parallel to ground plane 38. A coupling gap 46 may exist in the antenna array 700 between adjacent dipoles for Polarization 1, and a coupling gap 48 may exist in the array 700 between adjacent dipoles for Polarization 2. The phase center for the orthogonal polarizations associated with each unit cell is in the same location, because arms 32, 34 and arms 40, 42 are centered about the feed region, 36. Aperture 44 is the feed aperture for arm 34, but the whole feed region 36 could be a single aperture that allows all of the feeds from arms 32, 34, 40, 42 to pass through if the dimensions are too small to allow walls to exist between individual the dipole feeds.

Figure 8A:
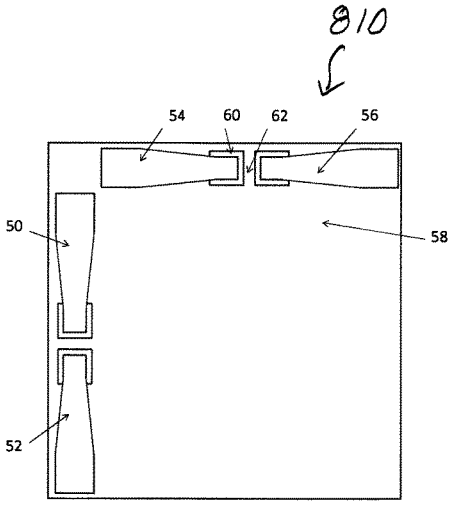
Figure 8B:
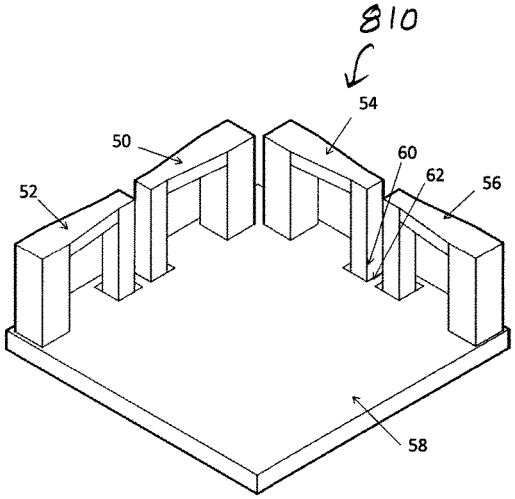
Figure 8C:
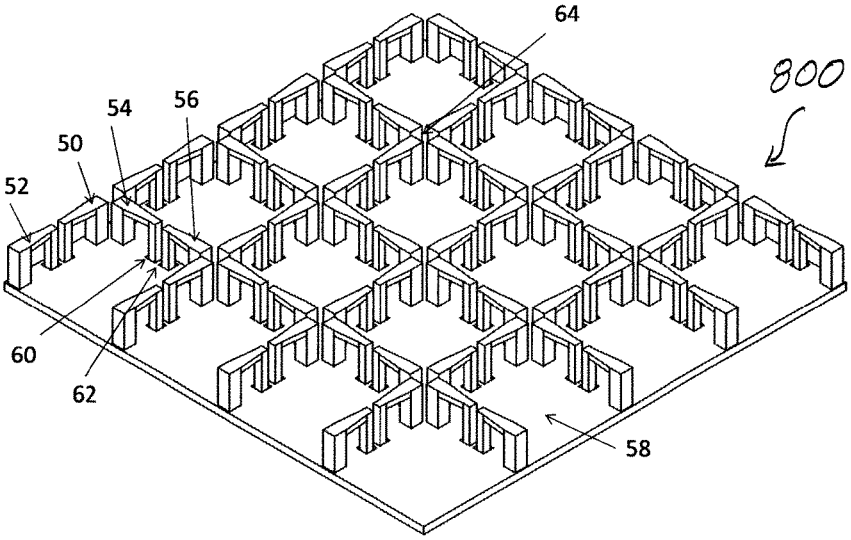
Figure 10B:
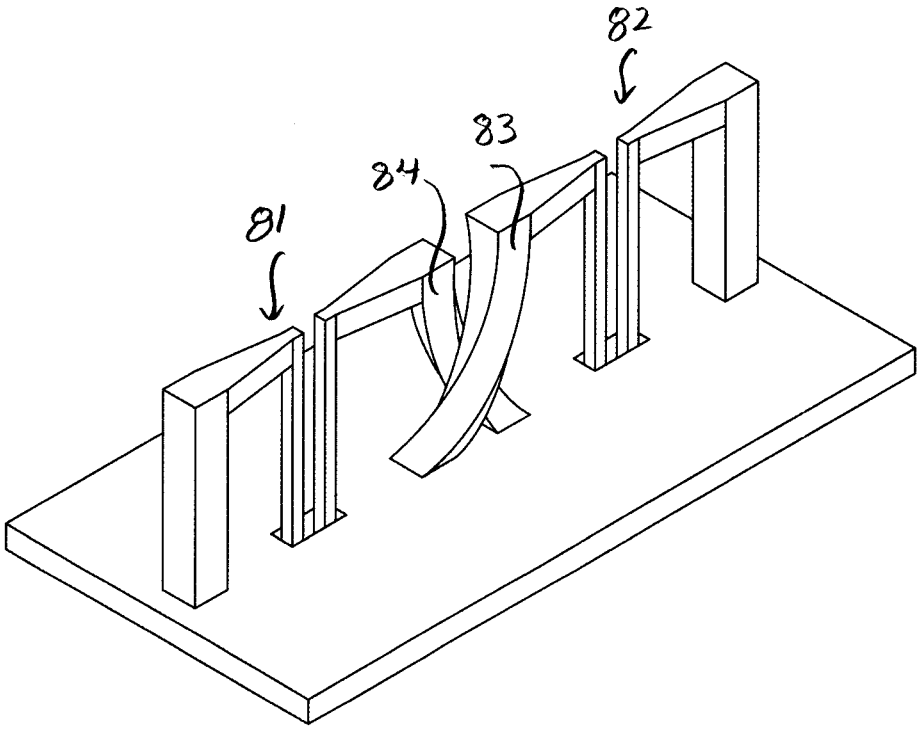

FIG. 8*c* shows a two-dimensional, 4-element by 4-element array 800 of dual-polarized differentially-fed shorted dipoles. The top view of the unit cell 810 that makes up the array 800 is shown in FIG. 8*a*. An isometric view of the unit cell 810 of the array 800 is shown in FIG. 8*b*. An isometric view of a representative 4×4 array 800 is shown in FIG. 8*c*. Arms 50, 52 make up two halves of a differentially-fed dipole element that is fed in polarization 1. Polarization 2 is orthogonal to polarization 1 and is fed by arms 54, 56, which make up the two halves of a second differentially-fed dipole element. The shorted dipole elements that are oriented in the same direction as arms 50, 52 throughout the array 800 also feed polarization 1. This polarization means that the electric field vectors for electromagnetic waves are oriented in the same direction as the physical components of arms 50, 52 that are oriented parallel to ground plane 58. A coupling gap 64 may exist between the adjacent dipoles for both polarizations. These coupling gaps 64 could be simple, as shown in the drawing, or they could be interdigitated in such a way as to selectively couple between adjacent dipoles for a given polarization, FIGS. 10*a*, 10*b*. The phase center for each polarization is centered between the two dipole arms associated with said polarization and the two phase centers for each polarization are offset with respect to the other. Aperture 60 is a feed region for the differentially shorted dipole arms 54, 56. A separation wall 62 may or may not exist between the arms 54, 56. One may choose to use offset orthogonal elements, as shown in FIGS. 8*a*-8*c*, to make it easier to place the beam-forming electronics behind the array.

Figure 9:
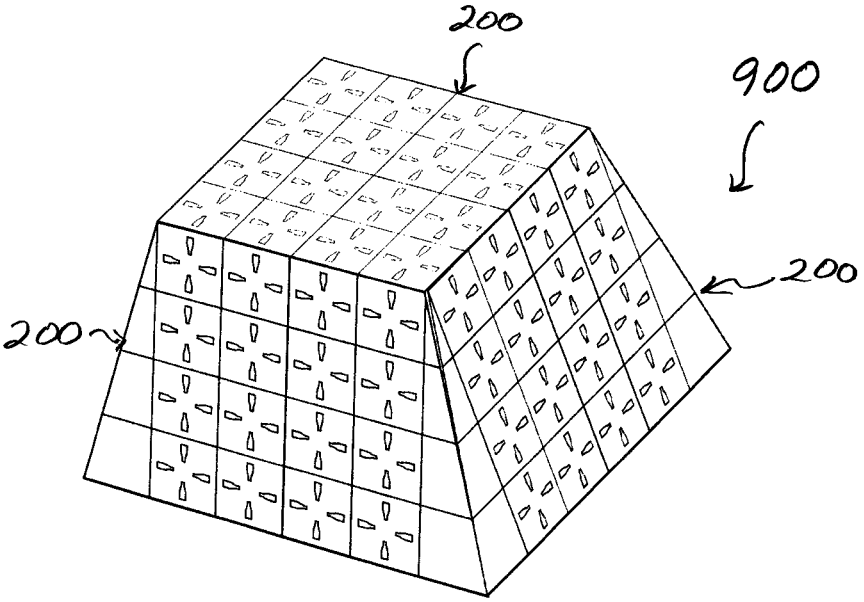
FIG. 9 schematically illustrates a three-dimensional array comprising multiple two-dimensional arrays of the present invention, such as the arrays of FIGS. 2, 7, 8.

These and other advantages of the present invention will be apparent to those skilled in the art from the foregoing specification. For instance, a plurality of two-dimensional arrays, such as the arrays 200, 700, 800, may be combined to provide a three-dimensional array 900, FIG. 9. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A two-dimensional array of dipole-coupled radiator structures, each radiator structure comprising:

a ground surface having first and second openings disposed therethrough; and a pair of antenna loops with each loop disposed in a respective plane perpendicular to the ground surface, a selected one of the loops having a first end shorted to the ground surface and a second end disposed in a respective one of the first and second openings, with the respective planes of the antenna loops oriented perpendicular to one another, wherein the loops comprise self-supporting metal-only structures such that the loops are not embedded in dielectric materials, wherein the array comprises dual-polarized differentially-fed shorted dipoles.

2. A two-dimensional array of dipole-coupled radiator structures, each radiator structure comprising:

a ground surface having first and second openings disposed therethrough; and a pair of antenna loops with each loop disposed in a respective plane perpendicular to the ground surface, a selected one of the loops having a first end shorted to the ground surface and a second end disposed in a respective one of the first and second openings, with the respective planes of the antenna loops oriented perpendicular to one another, wherein the loops comprise self-supporting metal-only structures such that the loops are not embedded in dielectric materials, wherein the array comprises a first pair of loops disposed in a first plane and a second pair of loops disposed in a second plane orthogonal to the first plane to provide a plus-shaped configuration of loops, where each of the loops of the first and second pairs comprises an end proximate the center of the plus-shape which ends are shorted to the ground surface.

3. A two-dimensional array of dipole-coupled radiator structures, each radiator structure comprising:

a ground surface having first and second openings disposed therethrough; and a pair of antenna loops with each loop disposed in a respective plane perpendicular to the ground surface, a selected one of the loops having a first end shorted to the ground surface and a second end disposed in a respective one of the first and second openings, with the respective planes of the antenna loops oriented perpendicular to one another, wherein the loops comprise self-supporting metal-only structures such that the loops are not embedded in dielectric materials, wherein the array comprises a first pair of loops disposed in a first plane and a second pair of loops disposed in a second plane orthogonal to the first plane to provide a plus-shaped configuration of loops, where each of the loops of the first and second pairs comprises an end proximate the center of the plus-shape which ends are disposed in an opening through the ground surface.

4. The dipole-coupled radiator structure according to any one of claims 1-3, wherein each loop of the pair of antenna loops includes a loop having a first end shorted to the ground surface and a second end disposed in a respective one of the first and second openings.

5. The dipole-coupled radiator structure according to any one of claims 1-3, comprising RF transmitter/receiver circuits below the ground surface in electrical communication with the second end of each loop.

6. The two-dimensional array according to any one of claims 1-3, comprising first and second adjacent antenna loops in the array which are capacitively coupled to one another.

* * * * *